US009993910B2

(12) United States Patent
Livingston

(10) Patent No.: US 9,993,910 B2
(45) Date of Patent: Jun. 12, 2018

(54) METHOD AND APPARATUS FOR PLIERS

(71) Applicant: Ronald Livingston, Piscataway, NJ (US)

(72) Inventor: Ronald Livingston, Piscataway, NJ (US)

( * ) Notice: Subject to any disclaimer, the term of this patent is extended or adjusted under 35 U.S.C. 154(b) by 154 days.

(21) Appl. No.: 15/099,149

(22) Filed: Apr. 14, 2016

(65) Prior Publication Data

US 2017/0297174 A1 Oct. 19, 2017

(51) Int. Cl.
*B25B 7/12* (2006.01)
*B25B 21/00* (2006.01)
*B25B 7/08* (2006.01)

(52) U.S. Cl.
CPC ..... *B25B 7/12* (2013.01); *B25B 7/08* (2013.01); *B25B 21/00* (2013.01)

(58) Field of Classification Search
CPC ..... B25B 7/12; B25B 21/00; B25B 7/08
USPC ..... 81/57.11
See application file for complete search history.

(56) References Cited

U.S. PATENT DOCUMENTS 1,760,167 A * 5/1930 Palmer ..... B25B 13/52 81/57.17
4,770,070 A * 9/1988 Sowers ..... B25B 7/00 81/418
5,249,487 A * 10/1993 Armfield, IV ..... B25B 23/00 81/186
5,735,182 A * 4/1998 Wild ..... B25B 13/481 81/424.5
5,735,353 A 4/1998 Undin
6,138,346 A 10/2000 Shutts et al.
6,196,045 B1 3/2001 Thomas et al.
6,510,723 B2 1/2003 Amherd
6,543,313 B2 * 4/2003 Samudosky ..... B25B 17/00 81/177.2
6,662,620 B1 12/2003 Baron et al.
7,263,917 B1 * 9/2007 Benysh ..... B25B 13/481 81/186
7,464,578 B2 12/2008 Ayer et al.
D623,493 S 9/2010 Anderson
7,836,797 B2 * 11/2010 Hecht ..... B25B 21/00 81/57.14

FOREIGN PATENT DOCUMENTS

DE 197 09 017 A1 12/1996

* cited by examiner

*Primary Examiner* — Hadi Shakeri
(74) *Attorney, Agent, or Firm* — Walter J. Tencza Jr.

(57) ABSTRACT

An apparatus including a first pliers handle having a first end and a second end; a second pliers handle having a first end and a second end; a first pivot pin which connects the first pliers handle, at a location between the first end and the second end of the first pliers handle and the second pliers handle at a location between the first end and the second end of the second pliers handle; and a first belt having teeth. The first belt having teeth may be configured to rotate while the first pliers handle remains stationary with respect to the second pliers handle. The first belt having teeth may be configured to be detached from the first pliers handle and the second pliers handle. The apparatus may include a motor located for rotating first belt while the first pliers handle remains stationary with respect to the second pliers handle.

12 Claims, 5 Drawing Sheets

METHOD AND APPARATUS FOR PLIERS

FIELD OF THE INVENTION

This invention relates to improved methods and apparatus concerning pliers.

BACKGROUND OF THE INVENTION

There are various devices known in the prior art for pliers.

SUMMARY OF THE INVENTION

In at least one embodiment, a pair of battery-powered pliers are provided. The battery powered pliers provide increased torque and turning power for fasteners and a wide variety of objects.

The battery powered pliers may be produced from tool grade steel and plastic and may feature the necessary electrical and mechanical components. The battery-powered pliers may measure eight to twelve inches long.

In at least one embodiment the apparatus may have an exterior configuration which may be similar to or the same as a conventional pair of pliers. However, the jaws and the interior of the lower handle may be modified so that this tool can be used with increased power.

A rechargeable battery may be housed in the bottom tip of the lower handle. A port may be provided that would accept the cord from a charger and would be positioned directly below the rechargeable battery.

A motor may be housed within the lower handle as well. A series of buttons may be embedded within this handle to control the function of the motor. There may be buttons dedicated to powering this tool and forwarding or reversing the function of the motor. In addition, a jaw lock button would be integrated into the design of the handle. The motor would be connected to a system of gears that would be connected to rotating jaws. The jaws may rotate clockwise or counterclockwise depending upon the forward or reverse motion of the motor and are removable, in at least one embodiment. The clockwise rotation of the jaws would tighten a fastener, such as a nut located on a bolt, or another object while the counterclockwise motion would loosen the fastener, such as a nut located on a bolt, or another object.

In at least one embodiment a battery-powered pair of pliers is provided that can be used with increased power and turning effectiveness.

The appealing features of at least one embodiment, are its ease of use, convenience, durability, power, effective tightening and loosening functions, timesaving qualities and efficiency, cost effectiveness, reduction of physical strain, and safety qualities.

One or more embodiments may not be adjustable, but alternatively, may come in different sizes so that the apparatus can be utilized by commercial workers such as trades people, construction laborers, general maintenance personnel, and automotive mechanics.

In at least one embodiment, an apparatus is provided which includes a first pliers handle having a first end and a second end; a second pliers handle having a first end and a second end; a first pivot pin which connects the first pliers handle, at a location between the first end and the second end of the first pliers handle and the second pliers handle at a location between the first end and the second end of the second pliers handle; and a first belt having teeth.

The first belt having teeth may be connected to the first pliers handle and located nearer the first end of the first pliers handle than to the second end of the first pliers handle. The first belt having teeth may also be connected to the second pliers handle and located nearer the first end of the second pliers handle than to the second end of the second pliers handle. The first belt having teeth may be configured to rotate while the first pliers handle remains stationary with respect to the second pliers handle. The first belt having teeth may be configured to be detached from the first pliers handle and the second pliers handle.

The apparatus may further include a motor located within either the first or second pliers handle, and a power source located within either the first or second pliers handle. The power source may be configured to power the motor to rotate the first belt while the first pliers handle remains stationary with respect to the second pliers handle.

In at least one embodiment, a method is provided which may include causing a first belt having teeth to rotate while a first pliers handle and a second pliers handle remain stationary. The first pliers handle, second pliers handle and the first belt having teeth may be configured as previously described. The first belt having teeth may be configured to be detached from the first pliers handle and the second pliers handle as previously described. The first belt having teeth may be configured to be controlled by a motor located within either the first or second pliers handle; wherein the motor is configured to be controlled by a power source located within either the first or second pliers handle; and wherein the power source is configured to power the motor to rotate the first belt while the first pliers handle remains stationary with respect to the second pliers handle.

DETAILED DESCRIPTION OF THE DRAWINGS

Figure 1:
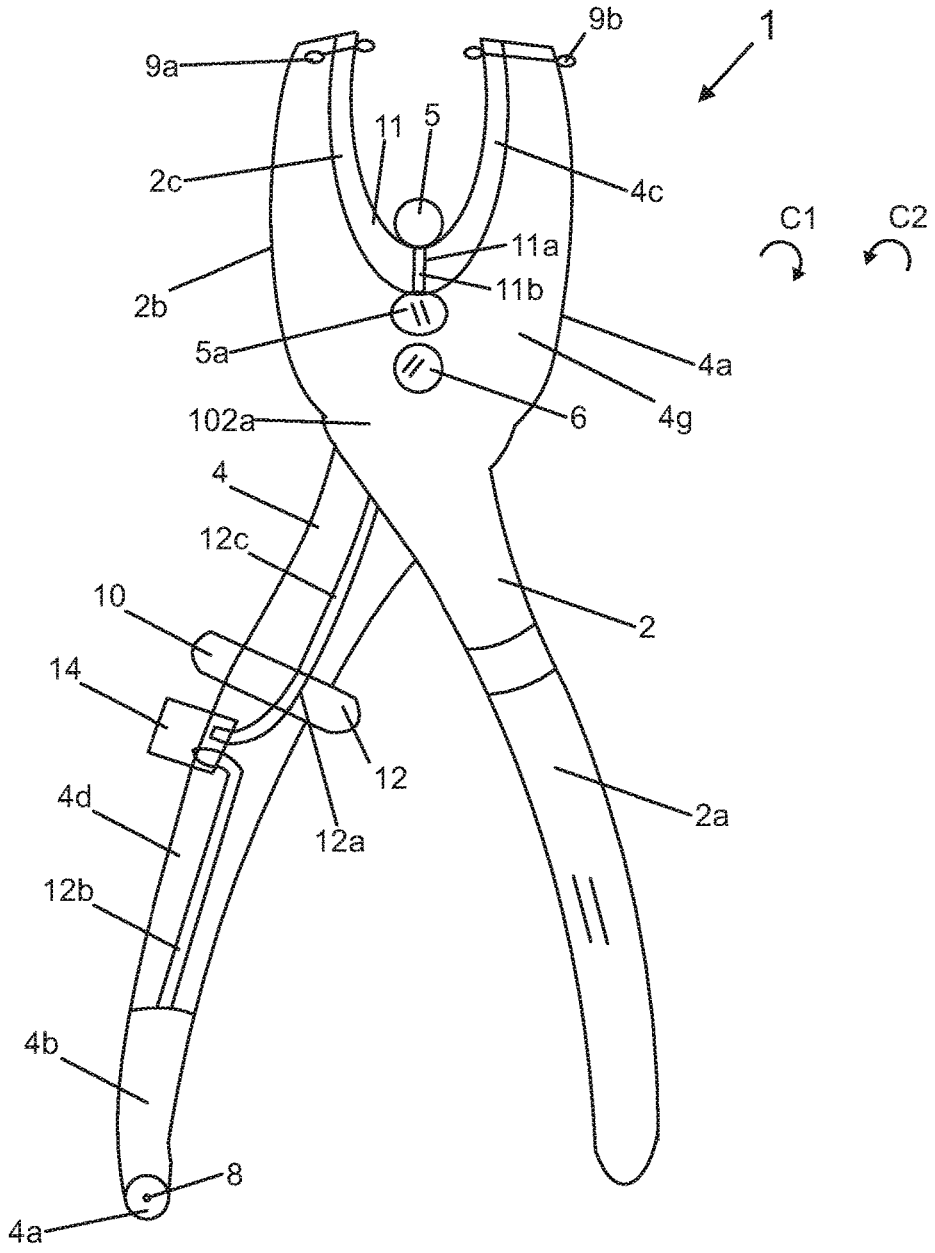
FIG. 1 shows a top view of a device in accordance with an embodiment of the present invention.
Figure 2:
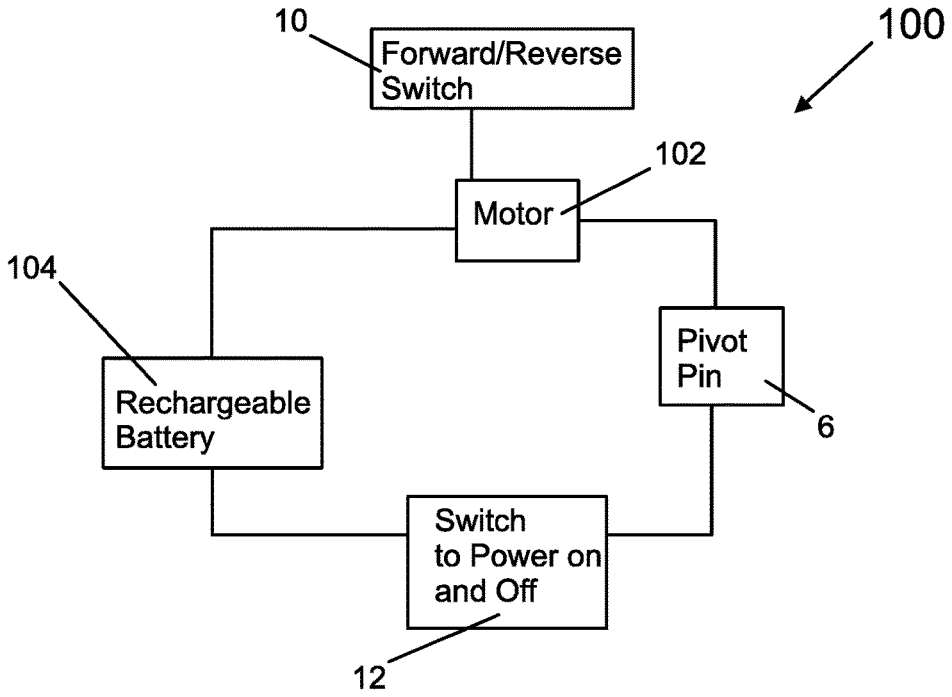
FIG. 2 shows a simplified block diagram of various components for use with the device of FIG. 1.

FIG. 1 shows a top view of a device 1 in accordance with an embodiment of the present invention. FIG. 2 shows a simplified block diagram of various components for use with the device 1.

Referring to FIG. 1, the device 1 may be generally in the form of a pair of pliers. The device 1 may include sections, handles, or portions 2 and 4, drive pinion 5 and 5*a*, drive pinion jaw locking clip 11*a* and 11*b* and holding pin 6 an electrical power cord port, terminal or insert region 8, a reverse switch and/or button 12, a forward switch and/or button 10, a forward switch and/or button 12*a*, connectors 12*b* and 12*c*, and a pressure sensitive trigger button 14.

The section, handle, or portion 2 is pivotally mounted to the section, handle or portion 4, so that section 2 and section 4 connect and open and close, as shown in FIG. 1.

The section 2 includes portion 2*a*, portion 2*b*, and inside opening 2*c*. The section 4 includes portions 4*a*, 4*b*, 4*g*, and inside opening 4*c*.

Figure 3:
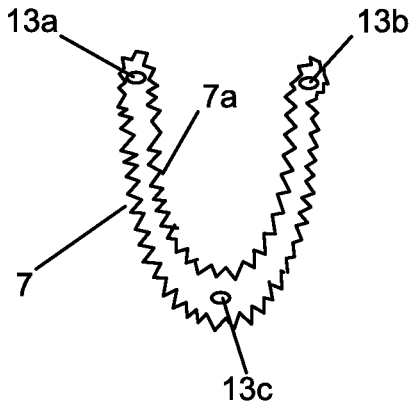
FIG. 3 shows a removable belt including teeth that can be attached to the device of FIG. 1 to form a complete apparatus, wherein the belt can be rotated clockwise in the direction C1 or counterclockwise in the direction C2 as shown by FIG. 4.

The device 1 also includes an opening 11 in which the inner teeth belt or bit, including teeth belt 2*d*, shown in FIG. 3, will be placed.

Figure 4:
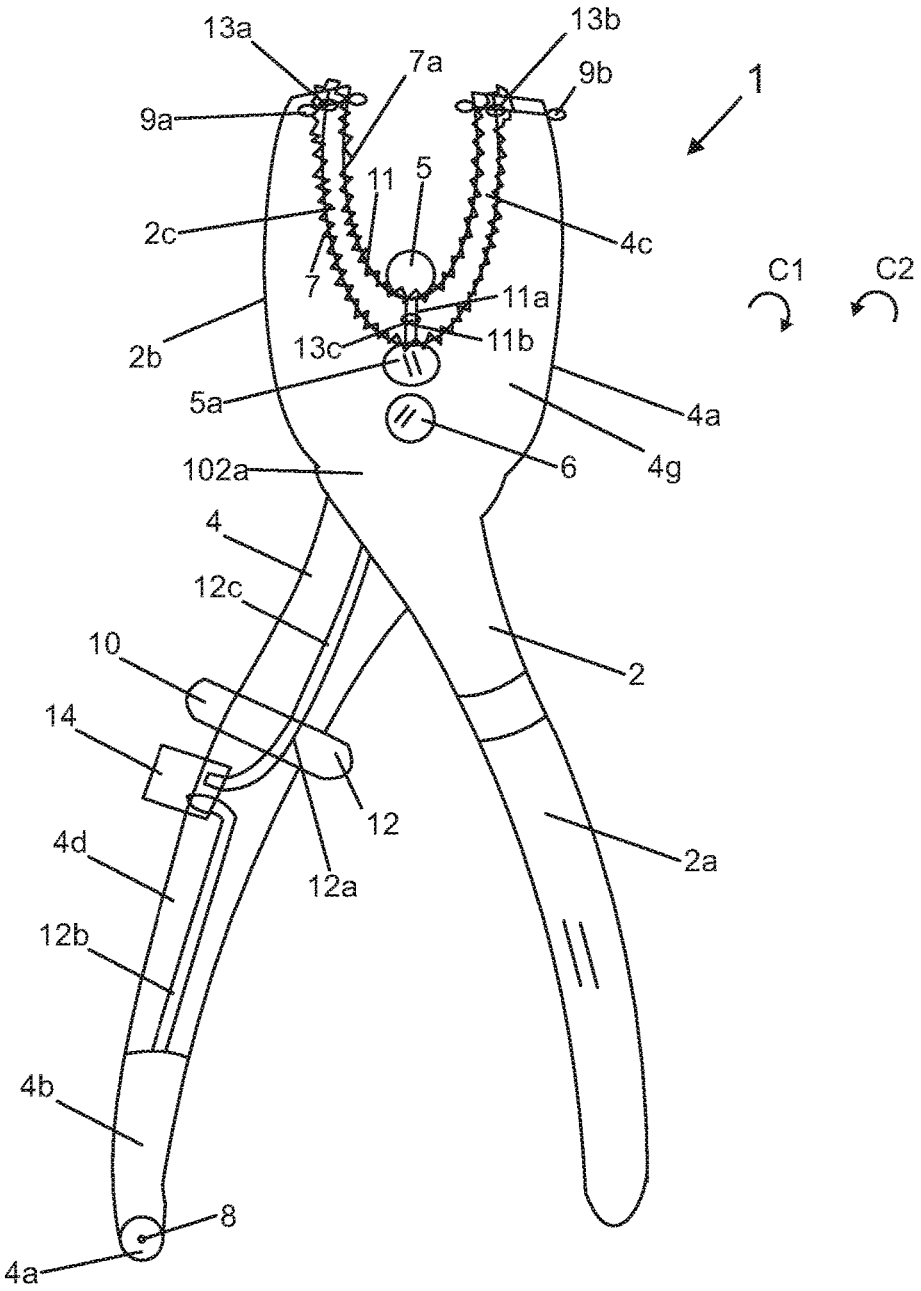
FIG. 4 shows the removable belt attached to the device of FIG. 1 to form a complete apparatus.

FIG. 3 shows a removable belt 7 including a plurality of teeth 7*a* that can be attached to the device 1 of FIG. 1, as shown in FIG. 4, to form a complete apparatus, wherein the belt 7 can be rotated clockwise in the direction C1 or counterclockwise in the direction C2 as shown by FIG. 4. FIG. 4 shows the removable belt 7 attached to the device 1 of FIG. 1 to form a complete apparatus. The removable belt 7 is attached by inserting pins of components 9*a* and 9*b* through openings of components 13*a* and 13*b*, and a pin of component 11*b* through opening 13*c*, and aligning the teeth with the drive pinion 5 and 5*a* to thereby attach belt 7 to the device 1, as shown by FIG. 4.

Figure 5:
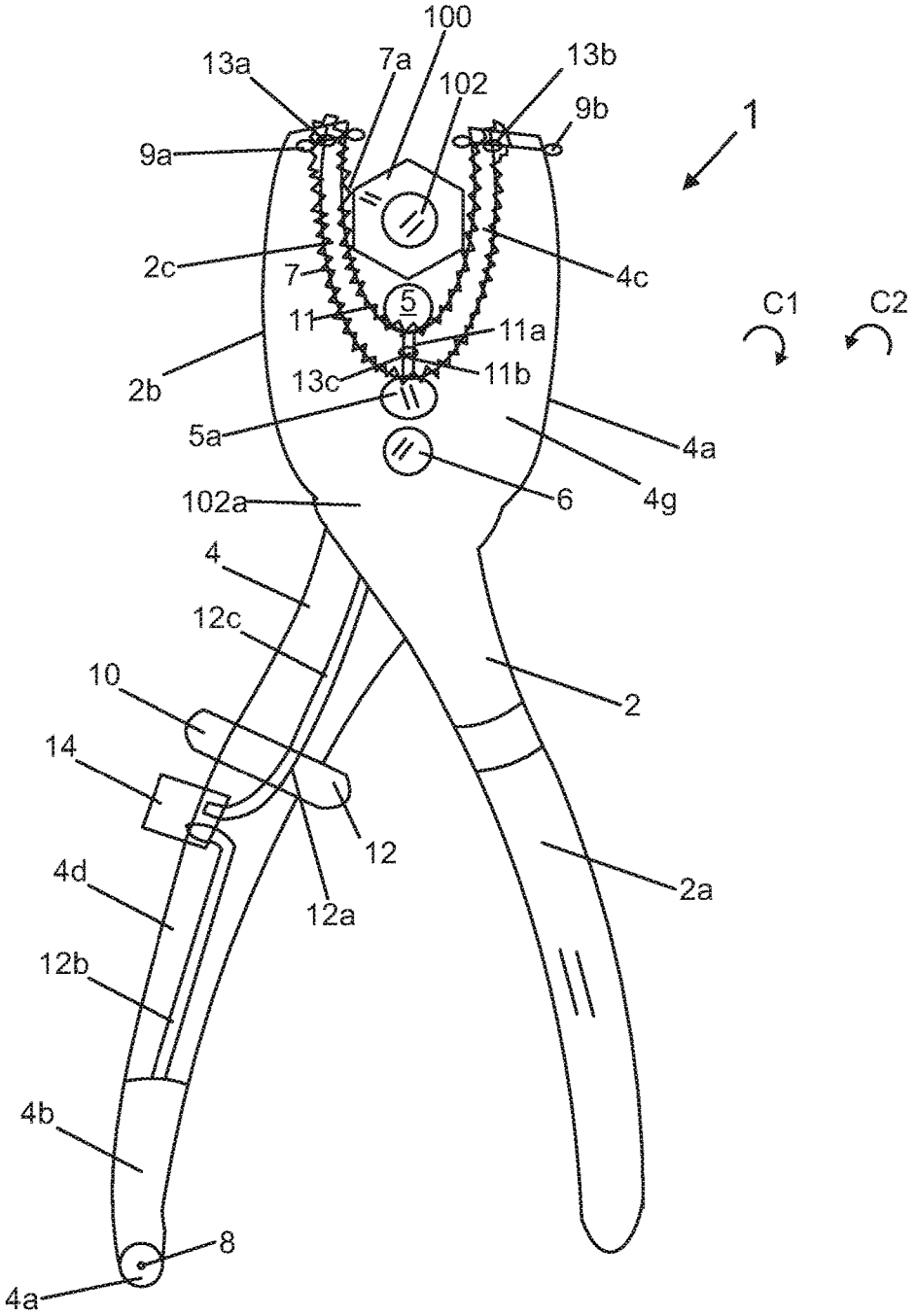
FIG. 5 shows a nut on a bolt which can be rotated to unscrew the nut from the bolt by the rotation of the belt of FIG. 3.

FIG. 5 shows a nut 100 on a bolt 102, wherein the nut 100 can be rotated to screw or unscrew the nut 100 from the bolt 102 by the rotation of the belt 7. One or more teeth 7*a* of the belt 7 engage the nut 100, and when the belt 7 rotates the nut 100 also rotates in order to screw or unscrew the nut 100 from the bolt 102 (depending on the direction of rotation of the belt 7).

Referring to FIGS. 1 and 2, in operation, an individual may push or otherwise activate the forward switch 10 and then push or otherwise activate the pressure sensitive trigger 14 to power the speed of the inner teeth belt 7 or bit section, which may include, inner teeth belt 7 and teeth 7*a*. This causes the motor 102 shown by FIG. 2 but not in FIG. 1, located under dashed lined area 102*a* shown in FIG. 1, powered by the rechargeable battery 104 to rotate the drive pinion and gears 5 and 5*a*, in a forward or clockwise direction C1 shown in FIG. 1, to rotate the inner teeth belt 7 and the teeth 7*a*. The battery 104 is located within the handle 4 in at least one embodiment. In at least one embodiment, the section, handle or portion 2 is fixed to the holding pin 6. The holding pin 6 is rotatably mounted to the motor 102 which is fixed and embedded inside of the handle or section 4 typically underneath the handle or section 2. The holding pin section 6, allows for the opening and closing of the handles section 2 and section 4 for the gripping of objects. Commercial grade plastic may be provided for section 2*b* and section 4*a* to enclose the inner teeth belt section 7. The inner teeth belt section 7 rotates around mechanical spin wheel 13*a*, 13*b*, 13*c* and clip or lock into 9*a*, 9*b* and 11*a*, 11*b* of the drive pinion section 5 and 5*a*. The inner teeth belt 7 rotates within a region defined by the plastic casing of components 2*c*, 4*c* and 11.

In at least one embodiment, when the pressure sensitive trigger 14 is not activated, i.e. turned off, the inner teeth belt 7 cannot be rotated, but rather the handle or section 4 and handles or sections 2 and 4 open and close with respect to each other.

When the pressure sensitive trigger 14 is activated, i.e. turned on, and the forward switch 10 was the most recently activated switch of switches 10 and 12, the drive pinion and gears 5 and 5*a* will cause the inner teeth belt or section 7 to rotate in a clockwise direction C1

When the pressure sensitive trigger 14 is pressed, and the reverse switch 12 was the most recently activated switch of switches 10 and 12, the drive pinion and gears 5 and 5*a* will cause the inner teeth belt or section 7 in a clockwise direction C1.

The handles or sections 2 and 4 may be made entirely or partially of hard commercial grade plastic. The handles or sections 2 and 4 may be made entirely or partially of metal. Section 2*a* may have a plastic cover for comfort. The handle or section 4 may include a section 4*g* which may include a plastic covering which can be removed to access the motor 102 or other components. The section 4*d* may include a plastic covering. The battery 104 may be stored in the section 4*b*, which may have a removable covering.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a first pliers section having a first end and a second end;

a second pliers section having a first end and a second end;

a first holding pin which connects the first pliers section to the second pliers section, at a location between the first end and the second end of the first pliers section and between the first end and the second end of the second pliers section;

a first belt having teeth;

wherein the first belt having teeth is connected to the first pliers section and located nearer the first end of the first pliers section than to the second end of the first pliers section;

wherein the first belt having teeth is connected to the second pliers section and located nearer the first end of the second pliers section than to the second end of the second pliers section; and wherein the first belt having teeth is configured to rotate while the first pliers section remains stationary with respect to the second pliers section; and wherein the first belt having teeth is connected to the first pliers section and the second pliers section such that the first belt having teeth substantially defines an arc having a starting point at the first end of the first pliers section and a termination point at the first end of the second pliers section and a midpoint approximately equidistant from the first end of the first pliers section and from the first end of the second pliers section; and wherein the holding pin pivotally mounts the first pliers section to the second pliers section so that the first pliers section and the second pliers section are configured to open and close.

2. The apparatus of claim 1 wherein the first belt having teeth is configured to be detached from the first pliers section and the second pliers section.

3. The apparatus of claim 1 further comprising a motor located within either the first or second pliers section;

a power source located within either the first or second pliers section;

and wherein the power source is configured to power the motor to rotate the first belt while the first pliers section remains stationary with respect to the second pliers section.

4. The apparatus of claim 1 wherein the first pliers section has a gripping region and a handle region;

wherein the gripping region of the first pliers section is substantially smaller than the handle region of the first pliers section;

wherein the second pliers section has a gripping region and a handle region;

wherein the gripping region of the second pliers section is substantially smaller than the handle region of the second pliers section;

wherein there is a gap region between the gripping region of the first pliers section and the gripping region of the second pliers section;

wherein the gap region has a perimeter; and wherein the first belt having teeth spans substantially the entire perimeter of the gap region.

5. The apparatus of claim 1 further comprising a first pin for attaching the first belt having teeth directly to the first end of the first pliers section at the starting point of the arc defined by the first belt having teeth;

a second pin for attaching the first belt having teeth directly to the first end of the second pliers section at the termination point of the arc defined by the first belt having teeth;

and a third pin for attaching the first belt having teeth at the midpoint of the arc defined by the first belt having teeth directly to a combination of the first pliers section and the second pliers section at a location approximately equidistant from the first end of the first pliers section and from the first end of the second pliers section.

6. A method comprising causing a first belt having teeth to rotate while a first pliers section and a second pliers section remain stationary;

wherein the first pliers section has a first end and a second end;

wherein the second pliers section has a first end and a second end;

wherein a first holding pin connects the first pliers section to the second pliers section, at a location between the first end and the second end of the first pliers section and the second pliers section at a location between the first end and the second end of the second pliers section, so that the first pliers section can rotate with respect to the second pliers section;

wherein the first belt having teeth is connected to the first pliers section and located nearer the first end of the first pliers section than to the second end of the first pliers section; and wherein the first belt having teeth is connected to the second pliers section and located nearer the first end of the second pliers section than to the second end of the second pliers section;

wherein the first belt having teeth is connected to the first pliers section and the second pliers section such that the first belt having teeth substantially defines an arc having a starting point at the first end of the first pliers section and a termination point at the first end of the second pliers section and a midpoint approximately equidistant from the first end of the first pliers section and from the first end of the second pliers section; and wherein the holding pin pivotally mounts the first pliers section to the second pliers section so that the first pliers section and the second pliers section are configured to open and close.

7. The method of claim 6 wherein the first belt having teeth is configured to be detached from the first pliers section and the second pliers section.

8. The method of claim 6 wherein the first belt having teeth is configured to be controlled by a motor located within either the first or second pliers sections;

wherein the motor is configured to be controlled by a power source located within either the first or second pliers sections;

and wherein the power source is configured to power the motor to rotate the first belt while the first pliers section remains stationary with respect to the second pliers section.

9. The method of claim 6 wherein the first pliers section has a gripping region and a handle region;

wherein the gripping region of the first pliers section is substantially smaller than the handle region of the first pliers section;

wherein the second pliers section has a gripping region and a handle region;

wherein the gripping region of the second pliers section is substantially smaller than the handle region of the second pliers section;

wherein there is a gap region between the gripping region of the first pliers section and the gripping region of the second pliers section;

wherein the gap region has a perimeter which is the arc; and wherein the first belt having teeth spans substantially the entire perimeter of the gap region.

10. The method of claim 6 wherein the first belt having teeth is attached directly to the first end of the first pliers section at the starting point of the arc defined by the first belt having teeth;

the first belt having teeth is attached directly to the first end of the second pliers section at the termination point of the arc defined by the first belt having teeth;

and the first belt having teeth is attached at the midpoint of the arc defined by the first belt having teeth directly to a combination of the first pliers section and the second pliers section at a location approximately equidistant from the first end of the first pliers section and from the first end of the second pliers section.

11. An apparatus comprising a first pliers section having a first end and a second end;

a second pliers section having a first end and a second end;

a first holding pin which connects the first pliers section to the second pliers section, at a location between the first end and the second end of the first pliers section and between the first end and the second end of the second pliers section;

a first belt having teeth;

wherein the first belt having teeth is connected to the first pliers section and located nearer the first end of the first pliers section than to the second end of the first pliers section;

wherein the first belt having teeth is connected to the second pliers section and located nearer the first end of the second pliers section than to the second end of the second pliers section; and wherein the first belt having teeth is configured to rotate while the first pliers section remains stationary with respect to the second pliers section; and wherein a jaws opening is located between the first end of the first pliers section and the first end of the first pliers section; and wherein first belt having teeth is located on a perimeter of the jaws opening so that when a nut is placed in the jaws opening, the first pliers section and the second pliers section can be closed to grip the nut by engaging one or more teeth of the first belt with the nut, and wherein the first belt is configured to rotate to cause the nut to rotate.

12. The apparatus of claim 11 wherein the first belt having teeth is connected to the first pliers section and the second pliers section such that the first belt having teeth substantially defines an arc having a starting point at the first end of the first pliers section and a termination point at the first end of the second pliers section and a midpoint approximately equidistant from the first end of the first pliers section and from the first end of the second pliers section.

* * * * *